US005218849A

United States Patent [19]

Sieger et al.

[11] Patent Number: 5,218,849

[45] Date of Patent: Jun. 15, 1993

[54] PROCESS AND DEVICE FOR METAL SPINNING

[75] Inventors: Erich Sieger, Friedrichshafen; Detlef Müller-Wiesner, Harpstedt; Michael Schnellbügel, Meckenbeuren, all of Fed. Rep. of Germany

[73] Assignee: Zeppelin-Metallwerke GmbH, Friedrichshafen, Fed. Rep. of Germany

[21] Appl. No.: 782,334

[22] Filed: Oct. 24, 1991

[51] Int. Cl.[5] ..... B21D 22/18

[52] U.S. Cl. ..... 72/69; 72/84

[58] Field of Search ..... 72/69, 82, 84, 111

[56] References Cited

U.S. PATENT DOCUMENTS 2,408,596 10/1946 Bednar et al. ..... 72/69
4,058,998 11/1977 Franek et al. ..... 72/84

FOREIGN PATENT DOCUMENTS 1938403 2/1971 Fed. Rep. of Germany .
343135 5/1904 France .
1039548 10/1953 France ..... 72/82
1467526 1/1966 France .
2154721 9/1972 France .
16816 1/1988 Japan ..... 72/84
201269 8/1925 United Kingdom .

OTHER PUBLICATIONS

Lehrbuch der Umformtechnik, Herausgegeben von Kurt Lange, Berlin Heidelberg, NY 1975, pp. 262–263.
Russian Language Book (reference 2) pp. 70–74.
The Tool and Manufacturing Engineer, "Hot-Roll Spinning Controls Wall Thickness", P. C. Sun, pp. 93–94.

*Primary Examiner*—Lowell A. Larson
*Attorney, Agent, or Firm*—Armstrong, Westerman, Hattori, McLeland & Naughton

[57] ABSTRACT

A process and a device for metal spinning a blank into a formed part, especially into a vessel bottom, are described, which can be used for forming materials including materials which are difficult to deform, with high dimensional accuracy and/or high degrees of deformation. For attaining this object, the blank is clamped on its circumference and forced freely, i.e. without using a spinning chuck, into a clearance by means of a motion-controlled spinning tool until its finished dimension is reached.

45 Claims, 2 Drawing Sheets

PROCESS AND DEVICE FOR METAL SPINNING

BACKGROUND OF THE INVENTION

In metal spinning, a blank in the form of a sheet metal disk or a preform is rotated and formed into the desired, rotationally symmetric part by approaching and pressing a spinning tool against it.

A survey of known spinning processes is given in *Blech-Rohre-Profile* (1981) 11, pages 514 to 517.

In the known spinning processes, the blank is clamped centrically in a spinning chuck, the outside contour of which corresponds to the inside contour of the part to be formed. The spinning tool in the form of a spinning roller however follows the outside contour of the part to be formed in such a way that the blank can be formed between the spinning roller and the spinning chuck. Furthermore, it is known to use an internal spinning chuck with an inside contour that corresponds to the outside of the part to be formed.

In modern spinning devices, the spinning roller is motion-controlled via copying templates or via a numerical control. Although materials which are difficult to deform have already been spun by applying known spinning processes, the known processes are limited as to the forming of materials of increased strength into shapes with varying wall thickness and/or high demands on dimensional accuracy. When spinning materials of increased strength, springback is likely to occur. Thus dimensionally correct forming of such materials in a spinning chuck is very difficult.

Although spinning chucks can be manufactured relatively easily, the production costs are noticeably reflected in the cost of the formed part when only small quantities of parts are to be formed. If the material is spun prior to a strength-increasing heat treatment in order to improve its deformability during the subsequent heat treatment, especially with parts of varying wall thickness, dimensional deviations and especially inhomogeneities in the transition area between areas of different wall thickness may occur, which cannot be accepted for precision parts such as bottoms of fuel tanks for the aerospace industry.

SUMMARY OF THE INVENTION

Therefore an object of the invention is to provide a process and a device for the cost effective and dimensionally correct spinning of parts, chiefly made of materials which are difficult to deform.

This object is attained in a process wherein the blank is clamped on its circumference and is forced into a clearance until its finished dimension is reached.

In the process according to the invention, i.e. by motion-controlling the spinning tool with controlled pressure force and controlled path along the inside contour of the part to be formed, combined with spinning into a clearance until the finished dimension is reached, for example, springback behavior which may vary from part to part, can be compensated for without, for example, changing the dimensions of a spinning chuck. As the process is carried out without using a spinning chuck, cost-effective single-part productions are enabled with just the motion control of the spinning tools requiring changes.

It has been found particularly advantageous to carry out the spinning in a process at an elevated operating temperature which is below the hot-forming temperature or below the recrystallization temperature of the material used due to two-stage heating of the blank, with basically the whole blank being heated to and held at a first temperature below the operating temperature and only sections of the blank being heated to the operating temperature prior to the spinning.

It is already known to work at elevated operating temperatures in stretch forming in order to reduce the wall thickness and by using a spinning chuck and a spinning roller following the outside contour of the part. This elevated operating temperature is however just reached by sectionally heating the part by means of a gas flame for reducing the tensile strength of the material and for decreasing the strain hardening due to the deformation. However, such an operation results in stresses and inhomogeneities in the finished part. By means of the two-stage heating according to the invention, with the whole blank being held at a constant, elevated temperature which, however, is below the operating temperature, the blank being only sectionally heated to the operating temperature, the occurrence of stresses and the fixing of inhomogeneities in the material is definitely avoided. The measures according to this aspect of the invention are particularly advantageous when the part is formed freely in air, but they also can be used in conventional spinning processes.

When the blank is heated to the first temperature below the operating temperature by means of circulating hot air and individual sections of the blank are heated to the operating temperature by means of coherent light (infrared), the result is particularly uniform heating in the two heating stages, thereby ruling out local overheating as far as possible.

The process according to the invention is especially suitable for forming materials which can be subjected to elevated-temperature age hardening, such as increased strength aluminum alloys or the like. The process according to the invention enables such alloys to be formed after a first strength-increasing treatment step, for example in the stretched and age hardened state, in which such alloys normally only have a low degree of deformation. However by employing the process according to the invention and by operating in the temperature range of elevated-temperature age hardening, degrees of deformation over 70 and up to nearly 100 percent may be obtained with high dimensional and geometrical accuracy. Here, the operating temperature is adjusted to the elevated-temperature age hardening curve of the specific material in such a way that the optimum increase in strength still is not reached during the time required for spinning. Thus, it is possible subsequently to subject the whole part, i.e. including the circumferential areas not spun near the clamping device, to a further age hardening step until the optimum increase in strength is obtained. If the circumferential areas of the part are distorted, it is, however, also possible to adjust the operating temperature during spinning to the time required for spinning in such a way that a finish age-hardened part of optimum strength may be removed from the spinning device.

This object is attained by a device comprising a clamping device and a motion-controlled spinning tool wherein the clamping device is designed for clamping the blank on its circumference and wherein the clamping device is arranged in front of a clearance which is larger than the depth of the part, and the part is formed freely by concave spinning into the clearance until the finished dimension is reached.

The design of the device according to the invention is particularly simple, and it is just required to change the motion control of the spinning tool and possibly to change the opening of the clamping device, if a change-over from one part to a part of different shape must be effected. Moreover, the device according to the invention enables substantially improved consideration of a specific deformational behavior of a material as compared to using a spinning block.

Advantageous further aspects of the device according to the invention include provision of a two-stage heating device for spinning at an elevated operating temperature. In the first heating stage, the blank is heated to a temperature below the operating temperature and in the second operating stage a selected section of the blank is heated to the operating temperature before applying the spinning tool. A forming chamber is provided which comprises the clearance, and a supply pipe for supplying hot air is led into the forming chamber. In one embodiment, the hot air supply pipe is led in tangentially to the part. The supply pipe may be led in at the end of the forming chamber opposite the clamping device and an air outlet of the forming chamber is provided near the clamping device. In another aspect of the inventive device, a heat source, motion-coupled to the spinning tool, is provided for sectionally heating the blank. The heat source may be a source of incoherent or coherent (infrared) light. At least one temperature sensor is provided for monitoring the temperature of the blank.

DESCRIPTION OF THE PREFERRED EMBODIMENTS

Figure 1:
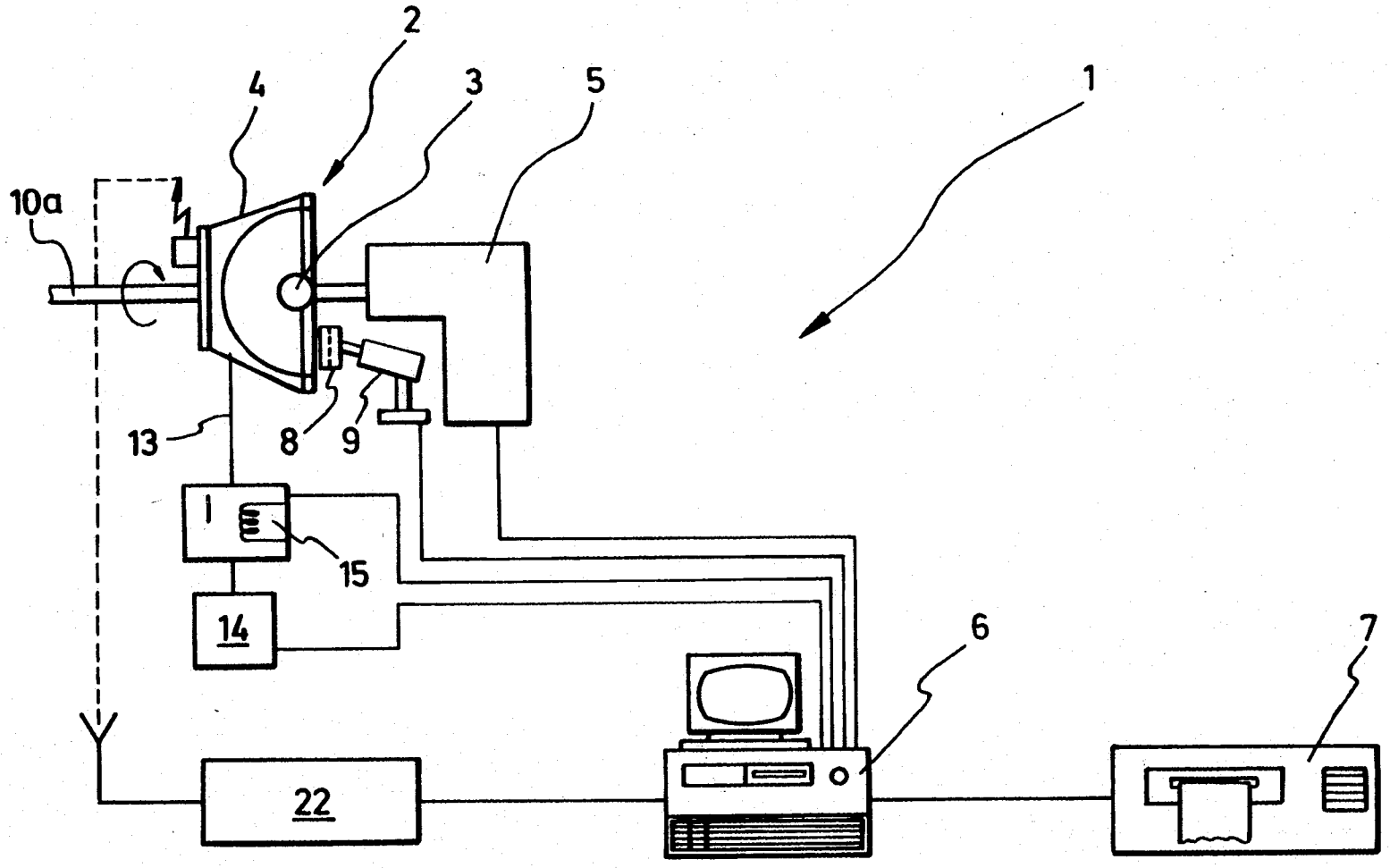
FIG. 1 is a diagrammatic view of a spinning device according to the invention.

In accordance with the invention, FIG. 1 shows a device, denoted generally by the numeral 1, for metal spinning. The device 1 comprises the actual spinning device, denoted generally by the numeral 2, with a spinning roller 3 and a forming chamber 4. The spinning roller 3 can be moved via a pneumatic device 5 in a known way, with the pressure force best suited to the specific shape and dimensions of the part and the material used, as well as the optimum path of motion of the spinning roller 3 being determined and controlled by a computer 6. The computer 6 is connected to a plotter 7.

Furthermore, the spinning device 2 comprises a sectionally effective, thyristor-controlled heat source 8, which operates with incoherent or coherent (infrared) light. The heat source 8 is moved via one of the known drives 9, with the movement of the heat source 8 being controlled by the computer 6 in such a way that the heat source 8 basically precedes the movement of the spinning roller 3.

Figure 2:
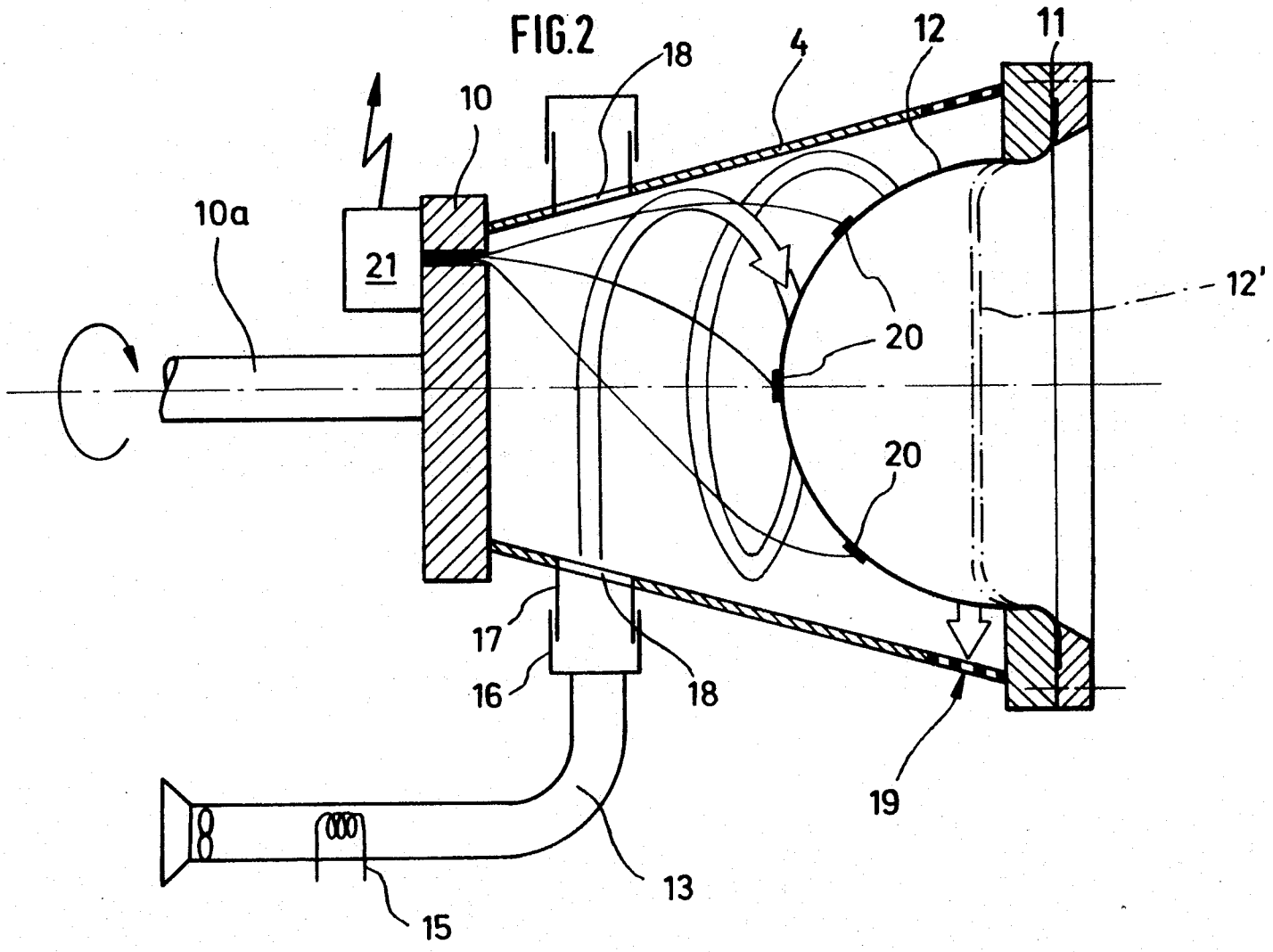
FIG. 2 is an enlarged detail of FIG. 1.

Referring next to FIG. 2, the forming chamber 4 comprises a hollow, truncated-cone-shaped wall which, on one side, is attached to a rotary disk 10 which is rotated by a shaft 10*a*. At the front of the forming chamber 4 facing the spinning roller 3, a clamping device 11 is attached, comprising two circular clamping elements for clamping the circumference of a workpiece. In the illustrated embodiment of the invention, a finished part 12 in the form of a hemispherical vessel bottom is clamped. Part 12 was formed from a blank 12' represented by the chain-dotted lines, the blank being preformed either by conventional spinning or by other known methods. The clamping device 11 slightly protrudes into the cross-section of the forming chamber 4. Furthermore in axial direction, the forming chamber 4 is longer than the axial finishing depth of the part 12. Thus, the part 12 is pressed freely, i.e. without using a spinning chuck, into the clearance inside the forming chamber 4 until its finished dimension is reached, with a space remaining between the blank 12' and the wall of the forming chamber 4 in all stages of the spinning process.

Near the end of the forming chamber 4 which is attached to the rotary disk, a supply pipe 13 for hot air is led in and which is connected to a blower 14 and contains a heating element 15. The supply pipe 13 comprises a fixed distributor ring 16 in which a flange arrangement 17, connected to the forming chamber 4, can rotate, which results in tangential feeding in of the air via inlet openings 18. The air is supplied in a direction opposite to the direction of rotation of the forming chamber 4, which results in the formation of air vortices inside the forming chamber 4. A high rate of air flow is intended to assure that the temperature of the air is not lowered substantially due to heating of the blank. Moreover, efficient swirling also provides a steady climate inside the forming chamber, which keeps the blank at a constant temperature.

For monitoring the temperature, several temperature sensors 20 are attached to the blank prior to inserting it in the clamping device 11. The sensors 20 transmit the measured temperature data to a telemetry sender 21 attached to the rotary disk 10. The temperature sensors are thermocouples which, during spinning, remain on the surface of the blank 12' opposite the spinning roller 3. Preferably eight thermocouples 20, evenly distributed over the surface of the blank 12', are used. The data measured by the thermocouples is radio-transmitted from the sender 21 to a receiver 22 (FIG. 1) which transmits the data to the computer 6. According to the measured temperature, the heat source 8, the heating element 15 or the blower 14, or all of them, are controlled. The operating temperature is predetermined for each material by means of its thermo-mechanical properties and is below the hot forming temperature or the recrystallization temperature.

For spinning a hemispherical vessel bottom from an aluminum alloy of increased strength, a basically dome-shaped blank 12' is first preformed from a sheet metal disk, either by applying a known spinning process using a spinning chuck or by some other suitable and known process. Subsequently, the blank 12' is provided with the temperature sensors in selected places and is clamped on its circumference between the clamping elements of the clamping device 11 in such a way that the preform already protrudes slightly into the forming chamber. Then the blower 14 and the heating element 15 are switched on and hot air is supplied to the forming chamber 4 until the blank 12' has reached an even temperature. For an aluminum alloy with a maximum age hardening temperature of approximately 180 degrees Celsius, this temperature is approximately 130 degrees Celsius. With rotating forming chamber, the spinning roller 3 and the heat source 8 are approached, the heat source 8 preferably being controlled in such a way that it directly precedes the operating area of the roller. The heat source 8 is controlled in such a way that the individual sections are heated to a temperature of 150 to 175 degrees Celsius directly before the spinning. The specific temperature of the individual sections can be selected according to the desired deformation.

In a process which, for example, is carried out in several stages and possibly with varying degrees of deformation, it is advantageous to operate at a temperature of 175 degrees Celsius in the first two stages and at a temperature of 150 to 160 degrees Celsius in the following stages. Starting from the geometrical conditions, the direction of application of force as well as the local conditions of friction in the contact zone of spinning roller and sheet metal, the forming process according to the invention is thus based on a combination of flexural, tensile, compressive and shear stresses, and consequently differs from straight flow turning over a spinning chuck at least in the last forming step. When the part 12 is finished, it is removed from the clamping device 11 and, after removal of the thermocouples, it is subjected to a further mechanical process or to further elevated-temperature age hardening until the best possible strength values are reached.

By modifying the described and illustrated embodiment of the invention, an induction heating or a different, known heat source can be used instead of the sectionally effective heat source. However, as a prerequisite, the heat source must provide for full soaking of the material without overheating the surface. If necessary, two or even more heat sources may be used. Instead of the computer control, a control by means of copying templates or a combination of both types of controls may be employed. The process in which the part is forced into a clearance without using a spinning chuck may also be carried out at room temperature. Moreover, it is possible to use the described two-stage heating in conventional spinning processes. The applied temperatures can be adjusted to the materials to be formed and/or to the desired thermal effects.

What is claimed is:

1. A process for metal spinning a generally flat metal workpiece into a formed part, which process comprises providing a generally circular metal workpiece, clamping the workpiece about a circumferential portion thereof, with a spinning tool pressed against one side of the workpiece forcing the workpiece into a clearance to form a hollow portion and forcing the hollow portion into the clearance with the spinning tool pressed against an inside wall of the hollow portion until a final part finished dimension is reached, in a first heating stage heating the entire workpiece to a first temperature below an elevated operating temperature for spinning, and in a second heating stage heating sections of the workpiece to be spun to the operating temperature, and wherein the operating temperature is below the recrystallization temperature of the workpiece metal.

2. A process according to claim 1, wherein the workpiece is heated to the first temperature by circulating hot air.

3. A process according to claim 1, wherein the individual sections of the workpiece are heated to the operating temperature by means of incoherent or infrared light.

4. A process according to claim 2, wherein the individual sections of the workpiece are heated to the operating temperature by means of incoherent or infrared light.

5. A process according to claim 4, wherein the formed part is a vessel bottom.

6. A process according to claim 1 further comprising measuring the temperature of the workpiece and generating a corresponding temperature signal, inputting the temperature signal to a temperature control unit and generating a temperature control signal, inputting the temperature control signal to temperature control means to control the temperature of the workpiece at a desired level.

7. A device for spinning a metal workpiece into a formed part, said device comprising a clearance for receipt of the part being formed by freely spinning the workpiece into the clearance, the clearance having a depth larger than that of the part to be formed, a clamping device for clamping the workpiece and arranged in front of the clearance, a motion-controlled spinning tool adapted to spin the workpiece into the clearance, and a two-stage heating device adapted, in a first stage component thereof to heat the workpiece to a first temperature below an operating temperature which is below the recrystallization temperature of the workpiece metal and, in a second stage component thereof, to heat to the operating temperature a section of the workpiece being spun.

8. A device according to claim 7, wherein the clearance comprises a forming chamber and wherein the device further comprises a hot air supply pipe for supplying hot air to the forming chamber.

9. A device according to claim 8 wherein the supply pipe is tangential to the part being formed.

10. A device according to claim 9, wherein the hot air supply pipe enters the forming chamber at an end thereof opposite the clamping device and wherein the device further includes an air outlet near the clamping device.

11. A device according to claim 10, additionally comprising a heat source motion-coupled to the spinning tool for sectionally heating the workpiece.

12. A device according to claim 11, wherein the heat source is a source of incoherent or infrared light.

13. A device according to claim 9, additionally comprising a heat source motion-coupled to the spinning tool for sectionally heating the workpiece.

14. A device according to claim 8, wherein the hot air supply pipe enters the forming chamber at an end thereof opposite the clamping device and wherein the device further includes an air outlet near the clamping device.

15. A device according to claim 14, additionally comprising a heat source motion-coupled to the spinning tool for sectionally heating the workpiece.

16. A device according to claim 8, additionally comprising a heat source motion-coupled to the spinning tool for sectionally heating the workpiece.

17. A device according to claim 10, further comprising at least one temperature sensor for monitoring the temperature of the blank.

18. A device according to claim 7, additionally comprising a heat source motion-coupled to the spinning tool for sectionally heating the workpiece.

19. A device according to claim 18, further comprising at least one temperature sensor for monitoring the temperature of the blank.

20. A device according to claim 7, further comprising at least one temperature sensor for monitoring the temperature of the workpiece.

21. A device according to claim 7, wherein the formed part is a hemispherical vessel bottom.

22. A device according to claim 7, wherein the spinning tool is a spinning roller.

23. A device according to claim 22, further comprising means to control movement of the spinning roller just behind the section of the workpiece heated by the second stage component of the heating device.

24. A device according to claim 23, further comprising means to control pressure force of the spinning roller against the workpiece in response to the shape and dimensions of the part and the material of the workpiece.

25. A device according to claim 7, further comprising means to measure the temperature of the workpiece and to generate a temperature signal, telemetry means to transfer the temperature signal to a temperature controller, means to generate a temperature control signal and to input such signal to said heating device to control the temperature of the workpiece at a desired level.

26. A device for spinning a metal blank into a formed part, said device comprising a clearance comprising a forming chamber for receipt of the part being formed by freely spinning the blank into the clearance, the forming chamber having a depth larger than that of the part to be formed, a clamping device for clamping the blank and arranged in front of the forming chamber, a motion-controlled spinning tool adapted to spin the blank into the forming chamber, and a hot supply pipe for supplying hot air to the forming chamber.

27. A device according to claim 26 wherein the supply pipe is tangential to the part being formed.

28. A device according to claim 27, wherein the hot air supply pipe enters the forming chamber at an end thereof opposite the clamping device and wherein the device further includes an air outlet near the clamping device.

29. A device according to claim 28, additionally comprising a heat source motion-coupled to the spinning tool for sectionally heating the workpiece.

30. A device according to claim 27, additionally comprising a heat source motion-coupled to the spinning tool for sectionally heating the workpiece.

31. A device according to claim 27, further comprising at least one temperature sensor for monitoring the temperature of the blank.

32. A device according to claim 26 wherein the hot air supply pipe enters the forming chamber at an end thereof opposite the clamping device and wherein the device further includes an air outlet near the clamping device.

33. A device according to claim 32, additionally comprising a heat source motion-coupled to the spinning tool for sectionally heating the workpiece.

34. A device according to claim 32, further comprising at least one temperature sensor for monitoring the temperature of the blank.

35. A device according to claim 26, additionally comprising a heat source motion-coupled to the spinning tool for sectionally heating the workpiece.

36. A device according to claim 26, further comprising at least one temperature sensor for monitoring the temperature of the workpiece.

37. A device according to claim 26, wherein the forming chamber is rotatable and the hot air supply is adapted to supply hot air to the forming chamber in a direction opposite to the direction of rotation thereof.

38. A device according to claim 37, wherein the hot air supply means is of sufficient capacity to prevent substantial lowering of the hot air temperature due to heating of the blank.

39. A device according to the claim 39, further comprising means to change the rate of air heating, the volume of hot air supplied to the forming chamber, and the rate of heating of selected sections of the blank in accordance with a measured temperature of the blank.

40. A process for spinning a blank of an age hardenable metal into a formed part, which comprises heating the entire blank to a first, elevated temperature below a second, spinning temperature which is higher than the first temperature and below a maximum age hardening temperature of the metal, successively heating selected sections of the blank to the second temperature, and freely spinning into the formed part the selected heated sections into a clearance having a depth greater that the depth of the formed part.

41. A process according to claim 40, further comprising heating a stream of air sufficiently high to heat the blank to the first temperature, flowing the stream of heated air over the blank to heat the blank to the first temperature, subjecting selected sections of the blank to radiation of wavelengths selected from the group consisting of incoherent light and infrared radiation to heat said selected sections to the second, spinning temperature just prior to spinning.

42. A process according to claim 41, further comprising heating the metal blank prior to spinning to partially harden the metal, and spinning the blank at a spinning temperature which is within the range of temperatures at which the metal is hardenable to an extent less than its maximum temperature hardenability.

43. A process according to claim 42, wherein after spinning the formed part is further hardened by treatment at an elevated temperature above the spinning temperature.

44. A process according to claim 43, wherein the blank metal is an age hardenable aluminum alloy.

45. A process according to claim 41, wherein the radiation source is a source of infrared radiation.

* * * * *